United States Patent [19]

Halpern et al.

[11] 4,357,993

[45] Nov. 9, 1982

[54] ELEVATOR CAB CONSTRUCTION

[75] Inventors: Ernst Halpern, Plainview; Morris Kline, Dix Hills; Waldemar Guslawski, Bronx; Gopal S. Kukke, Flushing, all of N.Y.

[73] Assignee: Williamsburg Steel Products Co. Inc., Brooklyn, N.Y.

[21] Appl. No.: 216,337

[22] Filed: Dec. 15, 1980

[51] Int. Cl.[3] ..... B66B 9/00

[52] U.S. Cl. ..... 187/1 R; 52/585; 403/345

[58] Field of Search ..... 187/1 R, 2; 52/275, 52/282, 578, 579, 585, 582, 581, 588, 595; 403/292, 12, 21, 345, 363, 364; 292/95

[56] References Cited

U.S. PATENT DOCUMENTS

| | | | |
|---|---|---|---|
| 667,603 | 2/1901 | Stiven | 52/585 |
| 1,277,319 | 8/1918 | Joice | 52/578 |
| 1,809,508 | 6/1931 | Colby | 52/585 |
| 2,128,797 | 8/1934 | Bohnsack | 52/585 |
| 2,753,390 | 7/1956 | Feketics | 52/581 |
| 2,834,064 | 5/1958 | Clements | 52/578 |
| 3,810,341 | 5/1974 | Holz | 52/585 |
| 3,902,280 | 9/1975 | Spoar et al. | 52/585 |

FOREIGN PATENT DOCUMENTS

| | | | |
|---|---|---|---|
| 1149995 | 6/1844 | France | 187/1 R |

*Primary Examiner*—Joseph J. Rolla
*Assistant Examiner*—Kenneth Noland
*Attorney, Agent, or Firm*—Blum, Kaplan, Friedman, Silberman and Beran

[57] ABSTRACT

Laminated panels of thin construction form the sidewalls for an elevator cab. A channel caps the panels and prevents delamination and splitting when fasteners for ceiling panels are inserted into the wall edges. Walls connect using dado joints and hook and latch elements which are formed from identical blanks.

10 Claims, 4 Drawing Figures

ELEVATOR CAB CONSTRUCTION

BACKGROUND OF THE INVENTION

This invention relates generally to the cab of an elevator of the type used to vertically transport people or products and more particularly to an elevator cab construction having a lightweight construction and simplified assembly in the field. In the art of elevator cab construction, laminated walls having flake board centers are frequently used. To meet code requirements, the exterior surface of the walls is generally a sheet of steel but the interior of the walls within the elevator cab is covered with a sheet of plastic. It is most desirable that the construction of the entire elevator cab be lightweight but strong. The laminated construction provides a lightweight structure which is desirable from the point of view of cost in manufacture, shipping and assembly in the field. However, in order to most efficiently complete the cab by the addition of ceiling panels, it is necessary to drive fasteners into the top edges of the walls. As a result, the walls split or delaminate unless the wall has sufficient thickness. As a result, thicker wall panels are used than is desirable from the point of view of lightweight construction and efficient design.

Dado joints are frequently used to join wall panels at the corners. This is a simple and efficient joint design suitable for rapid assembly of the cab in the field. However, the nature of the joint produces an offset where the walls meet which requires careful shimming for a proper fit and orientation of the walls.

What is needed is an elevator cab construction which includes thin, lightweight wall panels adapted to support ceiling panels by simple fastening means. It is also desirable that the joint between the walls be simple and effective and quickly assembled.

SUMMARY OF THE INVENTION

Generally speaking, in accordance with the invention, an elevator cab of lightweight construction and simple assembly is provided. Laminated panels of thin construction form the sidewalls for the elevator cab. A channel caps the panels and prevents delamination when fasteners for ceiling panels are inserted into the wall edges. Thereby, the walls are made thinner without incurring damage during cab assembly. Walls connect using dado joints and hook and latch elements which are formed from identical blanks. The need for shims at the wall joints is eliminated.

Accordingly, it is an object of this invention to provide an improved elevator cab construction having thin, lightweight laminated walls.

Another object of this invention is to provide an improved elevator cab construction wherein fasteners for ceiling panels are inserted into the wall edges without damage to the walls.

A further object of this invention is to provide an improved elevator cab construction wherein wall joints are simply and efficiently completed without the need for shimming.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
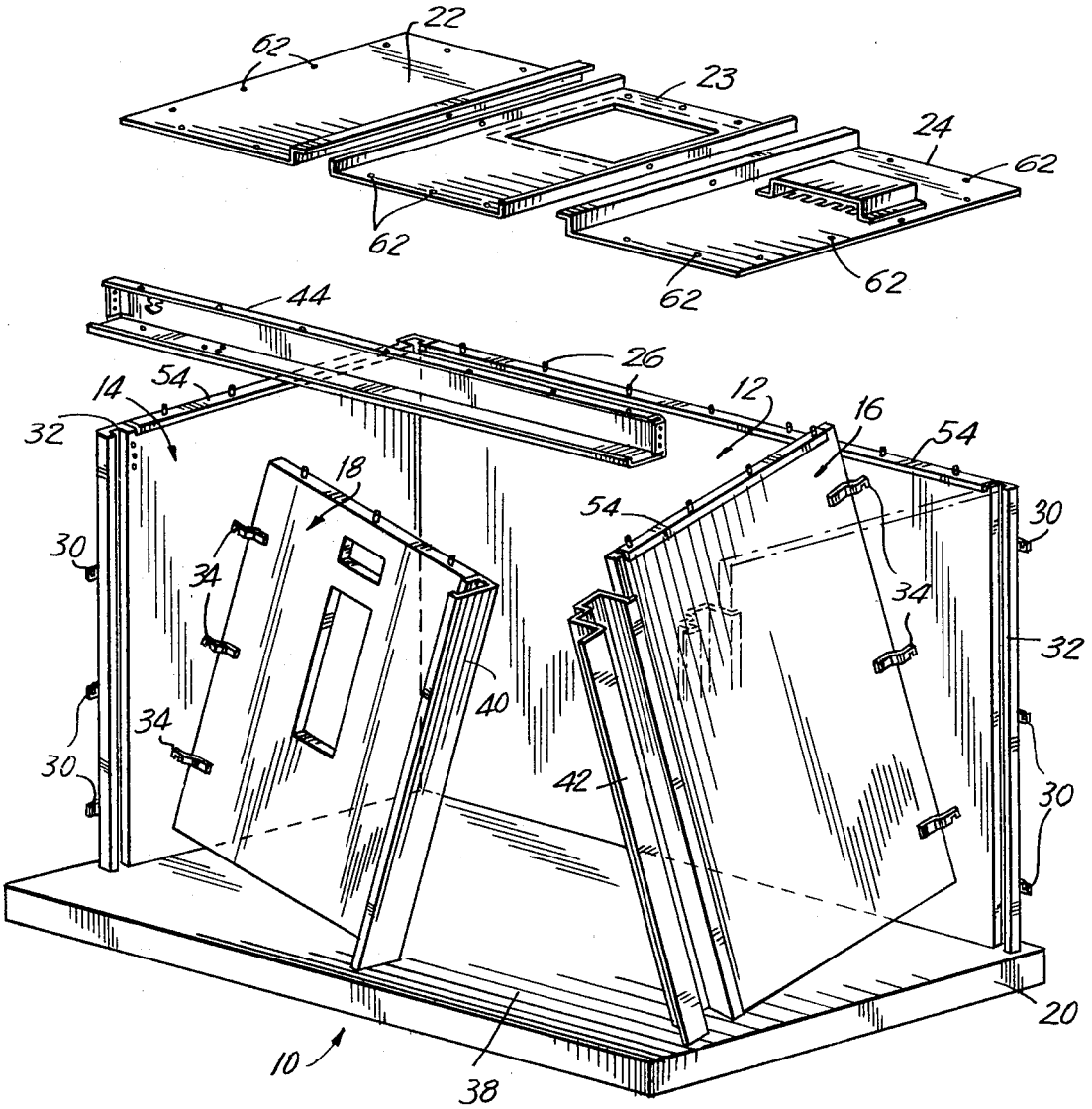
FIG. 1 is a top perspective view, partially exploded, of an elevator cab construction in accordance with this invention.

With reference to the figures, the elevator cab construction 10 in accordance with this invention includes a backwall panel 12, a left sidewall panel 14, a right sidewall panel 16, and a front panel 18. The panels are connected to an elevator platform 20 in any suitable manner (not shown). The elevator cab also includes a ceiling having three panels 22, 23, 24 which are joined together by abutting flanges.

The ceiling panels 22-24, rest atop the vertical walls and as explained more fully hereinafter are attached by stud fasteners 26 and nuts 28.

The wall panels 12,14,16,18 are joined together at right angles using dado joints to provide vertical alignment and a tight joint. Latch elements 30 are attached to the exterior wall surface of the wall panel having the dado groove 32 formed therein, for example, wall panels 12 and 14. The mating wall panels, namely, wall panels 16 and 18 have offset hooks 34 attached to the external panel surface. The offset hook engages with a notch 36 in the latch element at the time of assembly of the panel into the dado groove and holds the joined wall panels together in a fixed relationship.

The front panel 18 does not extend to meet the right sidewall panel 16, thereby leaving a door opening 38 at the front of the elevator cab 10. Door jams 40,42 are connected to the front panel 18 and right sidewall panel 16 respectively and a transom 44 extends across the front of the cab 10 to provide a top for the door opening 38 and structural support across the front of the cab.

The wall panels are of laminar construction including a thick layer of flakeboard 46 sandwiched between layers of rigid plastic 48,50. A sheet of steel 52 is bonded to the outer plastic layer 50 so as to meet the requirements of codes and regulations governing the construction of elevator cabs.

A cap 54 in the form of a shallow channel having legs 56 and a crossmember 58 rests atop each wall panel 12,14,16,18 with the wall panel cradled between the legs 56 of the cap 54.

Headless stud fasteners 26 are threaded into the flakeboard 46 passing through openings 60 in the cap 54. A straight threaded end of the stud 26 extends above the cap 54 and passes through a bolt hole 62 at the periphery of the ceiling panel. As best seen in FIG. 1, a plurality of studs 26 extend from the caps on each wall panel, and the ceiling panels 22-24 have bolt holes 62 distributed so that each stud fastener 26 passes through a bolt hole 62 when the ceiling panels are assembled atop the wall panels. The stud fasteners 26 are screwed into the wall panels prior to placement of the ceiling panels by using a conventional driver engaging a slot 27 in the end of the stud fastener 26. The stud fasteners 26 can be installed either at the factory prior to shipment or at the site where the elevator cab is being assembled. Predrilled holes in the cap 54 assure proper alignment. When the ceiling panels are in place, resting atop of the wall panels, nuts 28 are threaded onto the straight ends of the stud fasteners 26 to secure the ceiling to the walls. It should be noted in FIG. 1 that the ceiling panels 22-24 are joined together by means of bolts which pass through abutting flanges. Thereby, the ceiling panel is rigidized against buckling.

Figure 2:
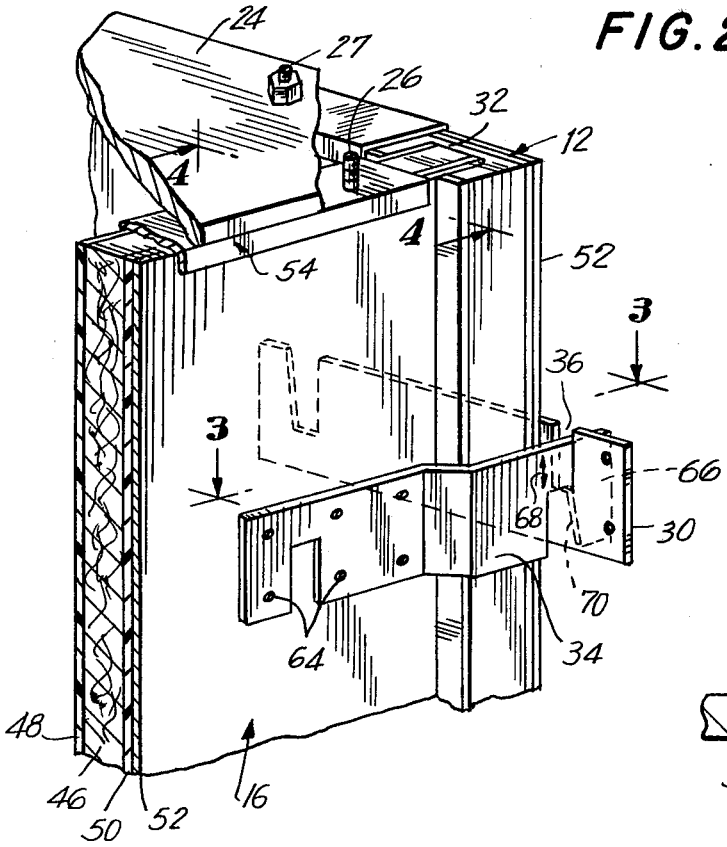
FIG. 2 is a fragmentary perspective view of wall to wall and wall to ceiling joints of FIG. 1.
Figure 4:
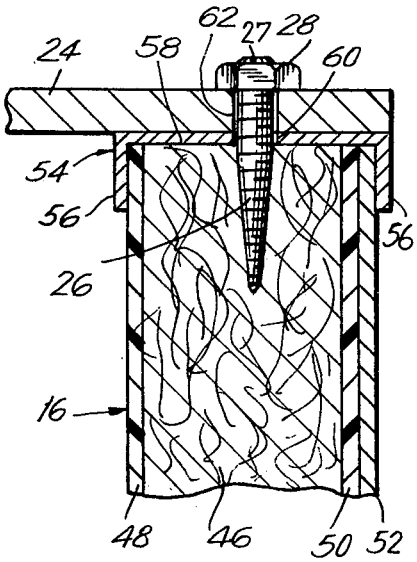
FIG. 4 is a sectional view taken along the line 4—4 of FIG. 2.
Figure 3:
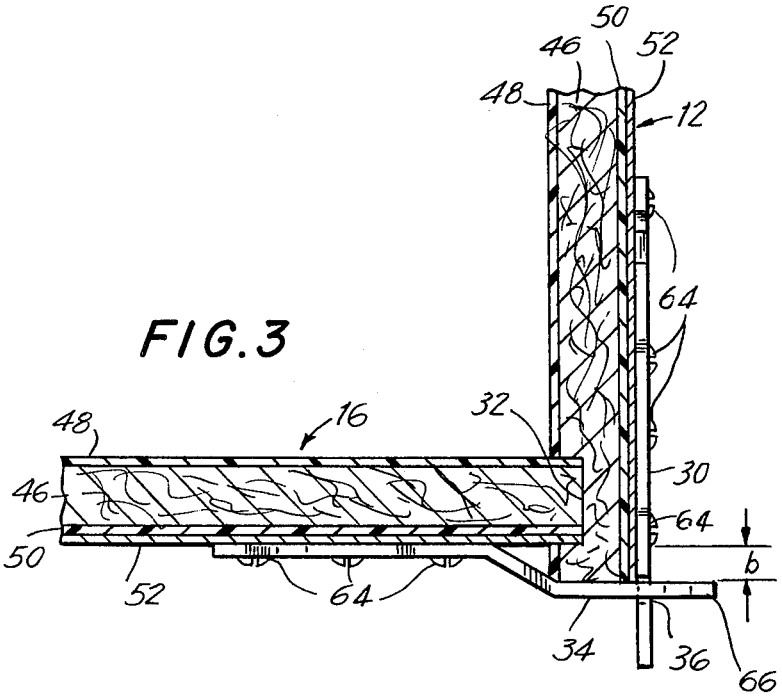
FIG. 3 is a sectional view taken along the line 3—3 of FIG. 2.

As best seen in FIGS. 2 and 3, wall panels are joined together by means of a dado joint including a rectilinear dado groove 32 recessed into the inner surface 48 of the wall panel and extending into the flakeboard 46. The dado groove 32 is offset by a distance b from the edge of the wall panel whereby an offset having the dimension b is produced at the joint. The hook 34 is attached to the exterior steel surface 52 of the panel by screw fasteners 64 extending into the flakeboard 46 and includes an offset bend such that the hook portion 66 of the hook 34 extends beyond the steel outer surface 52 of the transversely positioned interconnected wall.

The latch element 30 is attached to the external surface 52 of the wall having the dado groove 32 formed on the inner surface, by means of screw fasteners 64. The notch 36 in the latch element 30 is positioned to receive the necked portion 68 of the hook in the notch 36.

During assembly, the hooks 34 are brought into engagement with the latch elements 30 by positioning the hooks 34 above the notches 36 in the latch elements 30 and then lowering the wall panel bearing the hooks 34 into place. In FIG. 1, such an assembly operation is indicated where the wall panels 16, 18 bearing hooks 34 are tilted at one corner and then pivoted into place. A tapered edge 70 on the hook facilitates entrance of the necked portion 68 into the notch 36 and the drawing together of the panels. It should be noted that the latch elements 30 and the offset hooks 34 are, in the flat blank, identical components. A latch element 30 is converted into a hook 34 by forming the offset b in a flat blank element. Then, the hooks 34 are affixed to the wall panel with the tapered notch 70 extending beyond the end of the panel whereas the latch element 30 is affixed to the wall panel with the rectangular notch extending beyond the end of the wall panel. Efficiency in production is thereby achieved.

In summarizing, the wall panels are fitted with the cap 54 and studs 26 at the assembly site or these components can be pre-assembled at the factory. The wall panels are erected and joined together as described above and then the ceiling panels are lowered with the stud fasteners passing through the bolt holes 62 in the ceiling panels. Finally, nuts 28 are threaded onto the stud fasteners 26 to retain the ceiling panels.

Construction of the platform 20, joining of the wall panels to the platform 20, and construction of the door and associated mechanisms are not a novel portion of this invention and warrant and receive no further description herein.

It should be understood that in alternative embodiments of this invention, the headless stud fasteners 26 which are driven by a slot-type driver may be replaced by stud fasteners having recessed socket-type receptacles for driving. Or a headed stud fastener may be used which is driven into the wall panel after the ceiling panels are already aligned and resting on top of the cap 54.

The cap 54 prevents the splitting of the flakeboard or delamination of the wall panel and allows the thickness of the flakeboard to be substantially reduced. Thereby, a strong but lighter and thinner panel than in the prior art is produced. By this novel construction and the use of hooks 34 and latch elements 30 fabricated from identical component parts, production costs are substantially reduced. The need for shimming at the corner joints is eliminated and labor costs for assembly are reduced.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An elevator cab comprising:

a plurality of laminated wall panels, said panels being positioned on said platform to form at least a portion of an elevator compartment, at least two of said wall panels are joined at right angles one to the other, the vertical end of the first said joined panel abutting the inside surface of the second said joined panel, the outside surface of said first panel being offset from the end of said second joined panel;

a ceiling panel resting on the top edge surfaces of said laminated wall panels to form a ceiling for said compartment;

a hook element fixedly attached to the external surface of said first panel and extending beyond said end of said first panel, said hook element being offset to clear the end of said second panel;

a latch element affixed to the outside surface of said second panel, said latch element extending beyond the end of said second panel and having a notch therein, said hook element engaging in said notch whereby said first and second panels are joined together.

2. An elevator cab for attachment to an elevator platform as claimed in claim 1, and further comprising:

fastener means for joining said ceiling panels to said wall panels, said fastener means being fixed in the laminations of said wall panels and extending from said top edge surfaces, said ceiling panels including receiving means in registry for engaging said fastener means; and reinforcing means adjacent said top edge surfaces for laterally constraining said laminations from spreading apart, whereby said laminated wall panels are made thin without loss of strength and are not split by affixing said fastener means.

3. An elevator cab as claimed in claim 2, wherein said reinforcing means is comprised of channels, each having a crossmember with legs extending from the lateral edges thereof, said wall panels being received between said legs, said cross-members including apertures providing clearance for said fastener means.

4. An elevator cab as claimed in claim 3, wherein said fastener means are threaded into said laminations through said top edge surfaces, a portion of said threaded fastener means extending through said apertures in said ceiling panel.

5. An elevator cab as claimed in claim 4, and futher comprising nuts, said nuts being threaded on said protruding portion of said threaded fastener means, whereby said ceiling panel is sandwiched between said nuts and said channels.

6. An elevator cab as claimed in claim 1, wherein said hook element and said latch element are formed from similar blank elements.

7. An elevator cab for attachment to an elevator platform, comprising:

a plurality of wall panels, said panels being positioned on said platform to form at least a portion of an elevator compartment, at least two of said wall panels being joined at right angles one to the other, the vertical end of the first said joined panel abutting the inside surface of the second said joined panel, the outside surface of said first panel being offset from the end of said second panel;

a vertical recess formed in said inside surface of said second joined panel, said abutting end of said first panel being received in said recess, whereby said joined panels are constrained to stand vertically;

a first engaging member fixedly attached to the external surface of said first panel and extending beyond said end of said panel, said first engaging member being offset to clear the end of said second panel;

a second engaging member affixed to the outside surface of said second panel, said second engaging member extending beyond the end of said second panel and having engaging means thereon, said first engaging member being engaged by said second engaging member whereby said first and second panels are joined together.

8. An elevator cab for attachment to an elevator platform as claimed in claim 7, wherein said first engaging member is a hook element fixedly attached to the external surface of said first panel and extending beyond said end of said panel, said hook element being offset to clear the end of said second panel and;

said second engaging member is a latch element affixed to the outside surface of said second panel, said latch element extending beyond the end of said second panel and having a notch therein, said hook element engaging in said notch whereby said first and second panels are joined together.

9. An elevator cab as claimed in claim 8, wherein said hook element and said latch element are formed from similar blank elements.

10. An elevator cab as claimed in claim 7, wherein said recess is rectilinear in cross section.

* * * * *